United States Patent [19]

Wakabayashi et al.

[11] Patent Number: 4,604,167

[45] Date of Patent: Aug. 5, 1986

[54] SILVER PLATING SOLUTION AND SILVER PLATING PROCESS AND PRETREATMENT SOLUTION THEREFOR

[75] Inventors: Shinichi Wakabayashi; Masako Takoh, both of Nagano, Japan

[73] Assignee: Shinko Electric Industries Co., Ltd., Nagano, Japan

[21] Appl. No.: 574,253

[22] Filed: Jan. 26, 1984

[51] Int. Cl.[4] ..... C25D 3/46; C25D 5/34

[52] U.S. Cl. ..... 204/29

[58] Field of Search ..... 204/29, 46.1; 252/182

[56] References Cited

U.S. PATENT DOCUMENTS 4,247,372 1/1981 Nobel et al. ..... 204/15

FOREIGN PATENT DOCUMENTS 43995 12/1957 Japan ..... 204/46.1

131382 8/1982 Japan ..... 204/46.1

140891 8/1982 Japan ..... 204/29

*Primary Examiner*—G. L. Kaplan

*Attorney, Agent, or Firm*—Staas & Halsey

[57] ABSTRACT

A cyclic thion compound is incorporated as an anti-immersion agent into a cyanide-containing silver plating solution for use in silver plating onto a copper or copper alloy surface or into a pre-dipping solution for use in treating the copper or copper alloy surface before the silver plating using a cyanide-containing silver plating solution. Immersion deposition of silver on the copper or copper alloy surface is prevented, and a plated article free of defects and having good plating properties is obtained even if cyanogen is contained at a relatively high concentration in the plating solution.

6 Claims, No Drawings

SILVER PLATING SOLUTION AND SILVER PLATING PROCESS AND PRETREATMENT SOLUTION THEREFOR

BACKGROUND OF THE INVENTION

The present invention relates to a silver plating solution and silver plating process in which immersion deposition of silver on a substrate having a copper or copper alloy surface is effectively prevented.

Silver plating has heretofore been conducted by using a cyanide plating bath containing a large amount of a cyanide, but since Lerner proposed a low-cyanide silver plating bath in 1977 (U.S. Pat. No. 4,024,031), with development of the high-speed jet plating process, low-cyanide baths have been mainly utilized in practice for plating lead frames for semiconductors. In this field, in view of the problems on the use of saving of noble metals, the electro-migration of silver, and the soldering characteristics and the like, there has been developed a selective plating technique in which plating is effected only in a functionally required area such as a bonding area. When a silver plating solution comes in contact with copper or copper alloy, because of the difference of the ionization tendency between copper and silver, as is well-known, silver is readily immersion-deposited on copper. This phenomenon is one of the causes of the poor adhesion of the silver plating. In order to avoid occurrence of this undesirable phenomenon, it is indispensable to perform strike plating in advance. However, when the recently developed low-cyanide silver plating bath is employed, immersion deposition of silver is considerably moderated, and a certain adhesion is obtained even if silver plating is carried out without performing strike plating. However, in the selective plating process, in which frames are sealed with two masks and then a mask-plate, immersion deposition of silver is caused on the plated portion and the unplated portion for which plating is unnecessary, because of splashing of the plating solution at the transporting step and contamination of the mask surfaces with the silver plating solution, resulting in an uneven appearance or blistering. As means for solving this problem, Nobel et al proposed a process in which immersion deposition of silver is moderated by incorporating a mercaptan compound into a silver plating bath (U.S. Pat. No. 4,247,372). However, this process is still insufficient in some points. For example, in the case of bright plating, detrimental influences are produced in a low-current portion, and even though immersion deposition of silver is moderated, the deposition of silver is in such an amount as often causing blistering. Moreover, in a cyanide-containing bath, if the cyanogen concentration is higher than 2 g/l, the anti-immersion effect by the mercaptan compound is reduced and the decomposition speed of the compound is increased. In case of semi-bright or matte plating, if the thiolactic acid concentration is higher than 0.03 ml/l, the plating appearance is drastically degraded. In order to mass-produce selectively silver-plated articles having a high quality, therefore, it is necessary to eliminate the foregoing defects and develop an additive to a silver plating solution, which has an enhanced effect of preventing immersion deposition of silver and can also be used for a treating solution for performing an anti-immersion treatment before the silver plating step.

As discussed above, the background for development of an anti-immersion agent has been produced by the conversion of the cyanide bath to the low-cyanide bath in which the anti-immersion effect is relatively easy to obtain. However, the silver plating solution contains silver as cyanide salt so cyanogen is accumulated in the plating bath in accordance with the plating operation. Accordingly, development is desired of a new additive capable of exerting an anti-immersion effect even in the presence of free cyanogen.

Alphatic mercaptans have heretofore been used as the anti-immersion agent. These mercaptans, however, have a bad smell and their anti-immersion effect is insufficient. Since an anti-immersion agent is incorporated in a silver plating bath, it is required that the anti-immersion effect should not be degraded even if cyanogen is accumulated in the plating bath. However, the above-mentioned mercaptan type anti-immersion agents do not show any effect in the conventional cyanide silver plating baths. Namely, if cyanogen is present in the plating bath, the effect of the mercaptan type additive is drastically reduced, and if the cyanogen concentration is higher than 2 g/l, blistering is often caused. This problem may be solved by maintaining the anti-immersion effect at a high level by controlling the cyanogen concentration to a low level. For example, a considerable effect can be attained in a process in which silver cyanide (AgCN) packed in a bag is suspended as the silver source in the plating bath, or silver cyanide is charged in a filter pump as carbon in case of the carbon treatment, and cyanogen formed in the plating bath is absorbed by reacting it with silver cyanide as indicated by the following reaction formula:

$$AgCN + CN^- \rightarrow Ag(CN)_2^-$$

Generally speaking, however, from a practical viewpoint, it is desirable to develop a more superior anti-immersion agent, the effect of which will not be degraded even if the cyanogen concentration in the plating bath is as high as about 15 g/l. In the plating processes now adopted in the art, the anti-immersion agent also acts as a brightening agent, and the concentration is set so that both the functions can be exerted. However, the concentration suitable for the brightening agent is 1/50 or less of the concentration required for the anti-immersion agent. Even in case of bright plating, the defect due to addition of too large an amount of the anti-immersion agent is prominently manifested in a low current density portion where the current density is lower than 70 A/dm$^2$ in the jet plating process. In this case, however, a good bright plating is obtained in a region where the current density is 80 to 150 A/dm$^2$, and the above defect, therefore, is seemingly not so serious. However, in the low density portion of the plating, for example, defects are readily caused in the end face or side face of the mask or the back surface of the plated surface due, to insufficient plating, such as peeling and blistering, and these defects are very serious in practical operation. In case of matte silver plating, if the anti-immersion agent is incorporated into the plating bath in an amount sufficient to exert an anti-immersion effect, the range of the current density providing a good plating is extremely narrowed or not present at all, though this range differs to some extent according to the kind of the plating bath. As a means for avoiding this disadvantage, there has been adopted a method in which the anti-immersion treatment is carried out by pre-dipping, and the pre-dipped substrate is washed with water so as to control the amount of the anti-immersion agent to be dragged into the silver plating bath. However, even if this method is adopted, yelowing occurs on the plated surface within several days without fail, resulting in reduction of the current density used. Accordingly, it is impossible to use the plating bath for a long time. In view of the foregoing, it is desirable to develop an anti-immersion agent which exerts only the anti-immersion function when incorporated in a plating bath and which is inactive to the plating reaction.

As is apparent from the foregoing description, anti-immersion agents now available are insufficient in the following points. Namely, the anti-immersion effect is low, the effect is degraded in the presence of cyanogen, and, in the case of matte plating, detrimental influences are given to the plated surfaces to such an extent that practical application is not permissible.

SUMMARY OF THE INVENTION

It is a primary object of the present invention to provide an anti-immersion agent for a silver plating solution which has a high anti-immersion effect which is not degraded even in the presence of cyanogen.

Another object of the present invention is to provide a silver plating process in which selectively silver-plated articles having a strong plating adhesion are mass-produced by using a silver plating solution containing the above-mentioned anti-immersion agent.

Thus, the present invention provides an agent for preventing the immersion deposition of silver on a surface of copper or copper alloy in an electrolytic plating process for plating silver onto the copper or copper alloy surface, comprising a cyclic thion compound.

According to the present invention, there is also provided an electrolytic plating solution for plating silver onto a surface of copper or copper alloy, comprising an alkali metal silver cyanide and a cyclic thion compound.

According to the present invention, there is further provided an electrolytic plating process for plating silver onto a surface of copper or copper alloy, comprising treating the copper or copper alloy surface with a cyclic thion compound and plating the copper or copper alloy surface in an electrolytic plating solution containing an alkali metal silver cyanide.

DESCRIPTION OF THE PREFERRED EMBODIMENTS

In the present invention, the cyclic thion compound may preferably be selected from 5- or 6-membered heterocyclic compounds having a thion (=S) group on a ring carbon atom thereof. More preferably, the cyclic thion compound may be selected from 2-thiobarbituric acid, 2-thiouramil, 4-thiouramil, 3-thiourazol and 3-amino-rhodanine.

The cyclic thion compound may be incorporated as an anti-immersion agent into a low cyanide silver plating solution containing an alkali metal silver cyanide, such as potassium silver cyanide, as the silver salt. The silver plating solution may also contain an alkali metal citrate or phosphate, such as potassium citrate or potassium phosphate, as the main conductive salt. Alternatively, the cyclic thion compounds may be incorporated into a pre-dipping solution which may contain an alkali metal citrate or phosphate.

The concentration of the cyclic thion compound in the silver plating solution or in the pre-dipping solution may preferably be 0.005 to 5 g/l, more preferably 0.01 to 0.1 g/l, especially 0.01 to 0.03 g/l.

As will be appreciated from the above discussion, in the present invention, the treatment of the copper or copper alloy surface with the cyclic thion compound may be carried out concurrently with the silver plating of the copper or copper alloy surface in an electrolytic plating solution containing both the cyclic thion compound and the alkali metal silver cyanide. In this case, it is preferable that the silver ion is supplied from silver cyanide solely or in combination with potassium silver cyanide so that the cyanogen concentration in the electrolytic plating solution is controlled to a low level, preferably not more than 2 g/l.

Alternatively, the treatment of the copper or copper alloy surface with the cyclic thion compound may be carried out in the pre-dipping solution as hereinbefore mentioned, prior to the silver plating of the copper or copper alloy surface. In this case, the treated substrate may be subjected to the silver plating as such or after being rinsed. Then, the silver plating may preferably be carried out in an electrolytic plating solution containing up to 50 g/l of free cyanogen.

According to the present invention, a substrate having a copper or copper alloy surface is selectively plated with silver by an electrolytic silver plating technique while the immersion deposition of silver on the copper or copper alloy surface is effectively prevented. The resultant plated article is free of defects and has good plating characteristics even if a plating solution containing cyanogen at a relatively high concentration is used.

The present invention will now be described in detail with reference to the following examples that by no means limit the scope of the invention. In these examples, lead frames for semiconductors are selectively silver-plated by using a reel-to-reel automatic plating apparatus of the step-and-repeat system in which, as disclosed in the specification of U.S. Pat. No. 3,723,283 to Johnson et al, a substrate to be plated was masked with a mask for selective plating and the plating solution was sprayed on the surface to be plated from a jet nozzle to effect high-speed selective silver plating.

EXAMPLE 1

A silver plating solution comprising 130 g/l of $KAg(CN)_2$, 100 g/l of $K_2HPO_4$, 1 ppm of KSeCN and 0.02 g/l of 2-thiobarbituric acid was prepared. The pH value of this plating solution was 8.4, and a lead frame of Olin 195 was selectively plated by using the so-formed plating solution maintained at 70° C. In the low current density portion where the current density was lower than 50 A/dm$^2$, a matte silver deposit was obtained, and in the portion where the current density was 80 to 150 A/dm$^2$, a good bright silver deposit was obtained. In the non-plated area, the amount of immersion-depositted silver was very small and (immersion-deposited silver could hardly be noted with the naked eye), and no immersion unevenness was observed. The selectively silver-plated frame having bright and matte deposits was subjected to the heating test at 450° C. for 5 minutes, and the plated surface was observed by a microscope at 20 magnifications. Such defects as blistering and bare spots were not found at all.

When the above procedures were repeated in the same manner except that sodium 2-mercaptobenzothiazole was used instead of 2-thiobarbituric acid, a certain anti-immersion effect could be attained, but immersion unevenness was caused and small scratch-like defects were formed on the plated surface, and the plated lead frame could not be put into practical use.

EXAMPLE 2

A silver plating solution comprising 130 g/l of $KAg(CN)_2$, 100 g/l of tripotassium citrate and 0.02 g/l of 2-thiobarbituric acid was prepared. The pH value of this silver plating solution was 9.0. The plating operation was carried out by using this silver plating solution maintained at 70° C. In the portion where the current density was lower than 50 A/dm$^2$, a good matte silver deposit was obtained. Further, and as in Example 1, immersion deposition of silver hardly took place and a selectively plated lead frame having good plating quality was obtained. In this example, the plating operation was carried out by using a direct current power source. When an electric current of a single-phase full wave of 60 Hz was used, good semi-bright silver deposit was obtained in the range where the current density was 50 to 100 A/dm$^2$, and the plating quality was very good.

EXAMPLE 3

The plating operation was carried out at 80° C. by using a silver plating solution comprising 200 g/l of $KAg(CN)_2$, 90 g/l of $K_4P_2O_7$, 25 g/l of $KH_2PO_4$ and 0.02 g/l of 2-thiobarbituric acid. In the range where the current density was lower than 70 A/dm$^2$, good matte silver deposit was obtained, and it was found that the anti-immersion effect was satisfactory and the plating quality were very good.

In each of the above-mentioned low cyanide silver plating solutions, cyanogen is supplied only from the cyanide added as the silver salt. As silver is deposited with advance of the plating reaction, cyanogen is accumulated in the plating solution. The amount of cyanogen left in the plating solution depends on the state of stirring of the solution, the temperature and the pH value, and when the pH value is elevated, the amount of cyanogen left in the plating solution is especially increased. Furthermore, the larger the amount of siiver deposited, the more elevated is the pH value owing to accumulation of cyanogen, though the degree of elevation of the pH value differs according to the buffer capacity of the solution. Accordingly, the presence of a certain amount of free cyanogen in the plating solution cannot be avoided. Anti-immersion agents for preventing immersion deposition of silver on a copper substrate have such a tendency that the anti-immersion effect is drastically reduced or lost in the presence of cyanogen. Also 2-thiobarbituric acid or the like used in the present invention has this tendency. More specifically, if the cyanogen concentration is lower than 10 g/l, the amount of immersion-deposited silver is about $2.0\times10^{-3}$ mg/cm$^2$, but if the cyanogen concentration is 20 g/l, the amount of immersion-deposited silver is substantially doubled to $3.8\times10^{-3}$ gm/cm$^2$. This immersion deposition amount is smaller than $29.8\times10^{-3}$ mg/cm$^2$ obtained in the absence of the anti-immersion agent or $10.1\times10^{-3}$ mg/cm$^2$ obtained in the case of thiolatic acid. However, in the practical sense, in order to prevent blistering, it is important that the concentration of cyanogen present in the plating solution should be controlled to 2 g/l or less. For attaining this object, there may be adopted a method in which silver cyanide is packed in a cloth bag and suspended in the plating solution, or a method in which silver cyanide is charged in a filter pump and the plating bath is stirred to effect supply of the silver salt and removal of cyanogen. If this method is adopted, it is possible to maintain the cyanogen concentration below 2 g/l assuredly, the anti-immersion effect of the anti-immersion agent is enhanced, and stable control of the plating operation becomes possible.

Another embodiment of the present invention in which the anti-immersion agent is incorporated into a pre-dipping solution to be used before the silver plating operation will now be described with reference to the following example.

EXAMPLE 4

A pre-dipping solution comprising 1.8 g/l of $K_2HPO_4$ and 0.1 g/l of 2-thiobarbituric acid and having a pH value of 8.0 was prepared, and Olin 194 which had been strike-plated with copper was dipped in this pre-dipping solution. Then, the treated substrate was subjected to the plating operation using a plating solution which had been prepared in the same manner as described in Example 1 except that 2-thiobarbituric acid was not added. In this case, when the treatment rate was about 5 m$^2$/l, no reduction of the anti-immersion effect was caused and the anti-immersion effect attained was satisfactory. Dipotassium phosphate was commonly contained in both the pre-dipping solution and the plating solution, and if this compound was transferred into the palting solution from the pre-dipping solution, no trouble was caused. Furthermore, this dipotassium phosphate exerted the function of maintaining the pH value at about 8 where 2-thiobarbituric acid is stable and the pH is almost the same as the pH of the plating solution.

In case of the plating solution used in Example 2, if about 5 g/l of tripotassium citrate is used according to the above-mentioned considerations, good results are obtained.

In all of the foregoing examples, 2-thiobarbituric acid was used as the anti-immersion agent. It was confirmed that when 2-thiouramil, 4-thiouramil, 3-thiourazol or 3-aminorhodanine was used instead of 2-thiobarbituric acid in the foregoing examples, substantially equivalent results were obtained. However, from the practical viewpoint, use of 2-thiobarbituric acid is most preferred.

As is apparent from the foregoing description, according to the present invention, defects due to immersion deposition of silver, such as blistering, can be effectively prevented, detrimental influences of the prior anti-immersion agent present in the plating solution on the plated surface are eliminated, and immersion deposition of silver on the non-plated surface is prevented. Accordingly, a selectively plated article free of defects and having a good appearance can be obtained. Moreover, mass production of semi-bright and matte plated articles becomes possible.

We claim:

1. A pre-dipping solution for preventing the immersion deposition of silver on a suface of copper or copper alloy in an electrolytic plating process for plating silver onto a copper or copper alloy surface, comprising a cyclic thion compound selected from the group consisting of 2-thiobarbituric acid, 2-thiouramil, 4-thiouramil, 3-thiourazol and 3-aminorhodanine, and an alkali metal citrate or phosphate.

2. An electrolytic plating process for plating silver onto a surface of copper or copper alloy, comprising treating the copper or copper alloy surface with a cyclic thion compound selected from the group consisting of 2-thiobarbituric acid, 2-thiouramil, 4-thiouramil, 3-thiourazol and 3-aminorhodanine and plating the copper or copper alloy surface in an electrolytic plating solution containing an alkali metal silver cyanide.

3. A process according to claim 2, wherein the treatment and plating are concurrently carried out in an electrolytic plating solution containing both the cyclic thion compound and the alkali metal silver cyanide.

4. A process according to claim 3, wherein silver ions of said silver are supplied from silver cyanide solely or in combination with potassium silver cyanide so that the cyanogen concentration in the electrolytic plating solution is controlled to a low level.

5. A process according to claim 2, wherein the treatment with the cyclic thion compound is first carried out, and, the plating is then carried out onto the treated surface.

6. A process according to claim 5, wherein the plating is carried out in an electrolytic plating solution containing up to 50 g/l of free cyanogen.

* * * * *

UNITED STATES PATENT AND TRADEMARK OFFICE

CERTIFICATE OF CORRECTION

PATENT NO. : 4,604,167

DATED : 5 August 1986

INVENTOR(S) : WAKABAYASHI ET AL

It is certified that error appears in the above-identified patent and that said Letters Patent is hereby corrected as shown below:

Column 1, line 18, "on the use of saving of" should be --of saving on the use of--;
line 19, delete "and";
line 43, after "As" insert --a--.

Column 2, line 61, after "density" insert --for--.

Column 4, line 54, "depositted" should be --deposited--;
line 54, delete "and".

Column 5, line 16, "good" should be -- a good--;
line 25. "good" should be --a good--;

line 38, "siiver" should be --silver--.

Column 6, line 25, "palting" should be --plating--.

Column 8, line 5, "and," should be --and--.

Signed and Sealed this

Twenty-eighth Day of October, 1986

[SEAL]

*Attest:*

DONALD J. QUIGG

*Attesting Officer*

*Commissioner of Patents and Trademarks*